US012421884B2

(12) United States Patent
Qureshi et al.

(10) Patent No.: US 12,421,884 B2
(45) Date of Patent: Sep. 23, 2025

(54) DIESEL EXHAUST FLUID HEADER AND HEADER ADAPTERS

(71) Applicant: SHAW DEVELOPMENT, LLC, Bonita Springs, OH (US)

(72) Inventors: Faheem Qureshi, Bonita Springs, OH (US); Steve Milette, Bonita Springs, OH (US)

(73) Assignee: SHAW DEVELOPMENT, LLC, Bonita Springs, FL (US)

( * ) Notice: Subject to any disclaimer, the term of this patent is extended or adjusted under 35 U.S.C. 154(b) by 0 days.

(21) Appl. No.: 18/840,198

(22) PCT Filed: Feb. 27, 2024

(86) PCT No.: PCT/US2024/017425

§ 371 (c)(1),
(2) Date: Aug. 21, 2024

(87) PCT Pub. No.: WO2024/182362

PCT Pub. Date: Sep. 6, 2024

(65) Prior Publication Data

US 2025/0109704 A1 Apr. 3, 2025

Related U.S. Application Data

(60) Provisional application No. 63/448,404, filed on Feb. 27, 2023.

(51) Int. Cl.
*F01N 3/28* (2006.01)

(52) U.S. Cl.
CPC ..... *F01N 3/28* (2013.01)

(58) Field of Classification Search
CPC ..... F01N 2610/02; F01N 2610/1433
See application file for complete search history.

(56) References Cited

U.S. PATENT DOCUMENTS

| | | | | |
|---|---|---|---|---|
| 4,651,701 | A * | 3/1987 | Weaver | F02M 37/103 137/590 |
| 9,102,445 | B2 * | 8/2015 | Merchant | B65D 43/0229 |
| 9,683,874 | B2 * | 6/2017 | Hrncir | G01D 11/30 |
| 9,694,673 | B2 * | 7/2017 | Beauchaine | B60K 15/03 |
| 10,753,254 | B2 * | 8/2020 | Lorenz | F01N 3/208 |
| 11,142,062 | B2 * | 10/2021 | Aponte Hernandez | B60K 15/04 |
| 11,268,419 | B2 * | 3/2022 | Balea | F01N 3/2066 |

(Continued)

OTHER PUBLICATIONS

International Search Report and Written Opinion mailed May 13, 2024; International Patent Application No. PCT/US2024/017425 filed Feb. 27, 2024; ISA/US. 7 pages.

*Primary Examiner* — Anthony Ayala Delgado
(74) *Attorney, Agent, or Firm* — McDonald Hopkins LLC

(57) ABSTRACT

Disclosed is a diesel exhaust fluid header (DEF) and header adapters. The DEF header may have a base configuration or universal configuration. The header adapters may enable attachment of the base configuration DEF header to various different tanks and tank interfaces. The base configuration DEF header and corresponding header adapters may facilitate attachment of the base configuration DEF header to various different tanks and tank interfaces where each individual tank would usually otherwise require different headers having different attachment mechanisms to accommodate the specific tank structure.

17 Claims, 10 Drawing Sheets

(56) References Cited

U.S. PATENT DOCUMENTS

| | | | | |
|---|---|---|---|---|
| 2005/0194796 | A1* | 9/2005 | Powell | F02M 37/103 220/298 |
| 2010/0051621 | A1* | 3/2010 | Shimoda | B60K 15/0406 220/300 |
| 2010/0162690 | A1 | 7/2010 | Hosaka et al. | |
| 2014/0026990 | A1 | 1/2014 | Delihas et al. | |
| 2020/0182833 | A1* | 6/2020 | Rudolf | G01N 1/42 |
| 2021/0047956 | A1 | 2/2021 | Balea | |

* cited by examiner

DIESEL EXHAUST FLUID HEADER AND HEADER ADAPTERS

CROSS REFERENCE TO RELATED APPLICATIONS

This application is a 35 U.S.C. § 371 national stage application of PCT Application No. PCT/US2024/017425 filed on Feb. 27, 2024, entitled "DIESEL EXHAUST FLUID HEADER AND HEADER ADAPTERS," which claims priority to U.S. Patent Application No. 63/448,404, filed on Feb. 27, 2023, entitled "DIESEL EXHAUST FLUID HEADER AND HEADER ADAPTERS," each of which is incorporated herein by reference in its entirety.

FIELD OF THE DISCLOSURE

The disclosure relates to a diesel exhaust fluid (DEF) header and header adapters and, more particularly, a base configuration DEF header and individual corresponding header adapters that enable attachment of the base configuration DEF header to various different tanks and tank interfaces using one of the header adapters.

BACKGROUND OF THE DISCLOSURE

Diesel Exhaust Fluid (DEF) tanks have become standard on diesel powered ground vehicles since 2010 in the United States of America. DEF is a reduction agent and an Aqueous Urea Solution (AUS) that can be used in Selective Catalytic Reduction (SCR) diesel emissions systems. DEF has unique properties and is critical to the performance of emissions systems on diesel engine equipment equipped with SCR diesel emissions systems.

As such, it is typical to provide multiple sensors in the DEF reservoir. These sensors may monitor one or more of the fluid level, fluid temperature, fluid concentration (e.g., urea in water), etc. For example, a DEF fluid level sensor may measure the level of fluid remaining in the DEF tank. When the liquid level is low, the DEF level sensor can sends a signal to the vehicle's electronic control unit, which then triggers the warning light on the gauges or panel of the vehicle. Multiple sensor strategies are used to discern the reservoir and fluid conditions.

DEF headers may include one or more sensors that can be inserted into the DEF reservoir in order to measure and determine certain reservoir and fluid conditions. For example, a DEF header may include level sensors, temperature sensors, concentration sensors, etc. DEF headers may further include components such as coolant lines, fluid lines, suction tubes, and the like. DEF headers can transfer DEF of a desired and confirmed condition (e.g., DEF of a specified temperature, quality, amount, etc.) into an exhaust stream before the DEF continues through SCR. If the DEF does not meet certain threshold conditions as measured or determined by the DEF header, the DEF header can provide a signal or alert to the system, and can cause the system to stop the DEF flow or other processes until the problem is rectified. Such alerted conditions can include low DEF levels, contaminated DEF, DEF that is too hot or too cold, unmet concentration ranges, and the like.

DEF headers may generally include a portion that inserts into the DEF reservoir, a portion that interfaces or connects to the DEF reservoir, and a portion that extends out of the DEF reservoir and fluidly connects to the rest of the system. Given the differing structures of DEF reservoirs and attachment mechanisms on the DEF reservoirs, different DEF reservoirs require different DEF headers that are specific to this particular structure. Using a corresponding DEF header that properly attaches to the DEF reservoir is important so that the attachment between the components is sufficient to properly work within the system (e.g., provides a fluid seal, etc.). DEF headers therefore are specific to the DEF reservoir and are not generally adaptable to be used with different DEF reservoirs having different structures.

Given this, there is a need in the art for DEF headers and header adapters that facilitate attachment of a base configuration DEF header to a DEF reservoir or tank. There is a need for a base configuration DEF header and corresponding header adapters that facilitate attachment of the base configuration DEF header to various different tanks and tank interfaces where each individual tank would usually otherwise require different headers having different attachment mechanisms to accommodate the specific tank structure.

SUMMARY OF THE DISCLOSURE

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure. Any of the described aspects may be isolated or combined with other described aspects without limitation to the same effect as if they had been described separately and in every possible combination explicitly.

The disclosure relates to a diesel exhaust fluid (DEF) header and header adapters and, more particularly, a base configuration DEF header and individual corresponding header adapters that enable attachment of the base configuration DEF header to various different tanks and tank interfaces using one of the header adapters.

Disclosed is a DEF universal header and adapter assembly. In an embodiment, the assembly may comprise a universal header. In an embodiment, the universal header may comprise a first end, a second end, and an elongated body, wherein the second end and elongated body may be insertable into a reservoir. In an embodiment, the assembly may comprise an adapter. In an embodiment, the adapter may comprise a first face, a second face, and a through opening. In an embodiment, the through opening may form an inner peripheral wall including a header interface that is selectively attachable to a corresponding adapter interface on the universal header. In an embodiment, the adapter may further comprise a reservoir interface that is selectively attachable to the reservoir. In an embodiment, the adapter may facilitate attachment of the universal header to the reservoir.

In an embodiment, the universal header may be selectively attachable to more than one reservoir by corresponding adapters. In an embodiment, the corresponding adapters may include different reservoir interfaces that are configured to mate with different reservoirs. In an embodiment, the corresponding adapters may include the same header interface that are configured to mate with the universal header. In an embodiment, the header interface of the adapter may selectively interlock with the universal header by bayonet-style mounting features. In an embodiment, the header interface of the adapter may comprise two or more radial protrusions and alternating two or more recessed areas. In an embodiment, the header interface of the adapter may comprise eight radial protrusions and alternating eight recessed areas. In an embodiment, the one or more radial protrusions may be spaced at even intervals about the inner peripheral wall. In an embodiment, the adapter interface of the universal header may comprise two or more L-shaped slots selectively configured to receive the two or more radial protrusions of the header interface of the adapter.

In an embodiment, the selective interlocking of the header interface of the adapter and the adapter interface of the universal header may form a liquid tight seal. In an embodiment, the reservoir interface of the adapter may comprise bolts to selectively attach to the reservoir. In an embodiment, the reservoir interface of the adapter may comprise a bore seal to selectively attach to the reservoir. In an embodiment, the reservoir interface of the adapter may comprise a camlock to selectively attach to the reservoir.

Disclosed is a universal DEF header. In an embodiment, the universal DEF header may comprise a first end, a second end, and an elongated body, wherein the second end and elongated body may be insertable into a reservoir. In an embodiment, the universal DEF header may comprise an adapter interface, wherein the adapter interface may selectively interlock with an adapter. In an embodiment, the adapter may facilitate selective attachment of the universal DEF header to a reservoir.

In an embodiment, the universal DEF header may be selectively attachable to more than one reservoir by one or more corresponding adapters. In an embodiment, the adapter interface may selectively interlock with the adapter by bayonet-style mounting features. In an embodiment, the selective interlock between the adapter interface and the adapter and the selective attachment of the universal DEF header to the reservoir may form a liquid tight seal.

Disclosed is an adapter for a universal DEF header. In an embodiment, the adapter may comprise a first face, a second face, and a through opening. In an embodiment, the through opening may form an inner peripheral wall including a header interface that is selectively attachable to the universal DEF header. In an embodiment, the adapter may comprise a reservoir interface that is selectively attachable to a reservoir. In an embodiment, the adapter may facilitate attachment of the universal DEF header to the reservoir.

In an embodiment, the header interface may selectively interlock with the universal DEF header by bayonet-style mounting features. In an embodiment, the reservoir interface may include one of: bolts, a bore seal, or a camlock to selectively attach to the reservoir.

The following description and the drawings disclose various illustrative aspects. Some improvements and novel aspects may be expressly identified, while others may be apparent from the description and drawings.

BRIEF DESCRIPTION OF THE DRAWINGS

Operation of the present teachings may be better understood by reference to the detailed description taken in connection with the following illustrations, in which like reference characters refer to like parts throughout. These appended drawings form part of this specification, and written information in the drawings should be treated as part of this disclosure. In the drawings.

Figure 1:
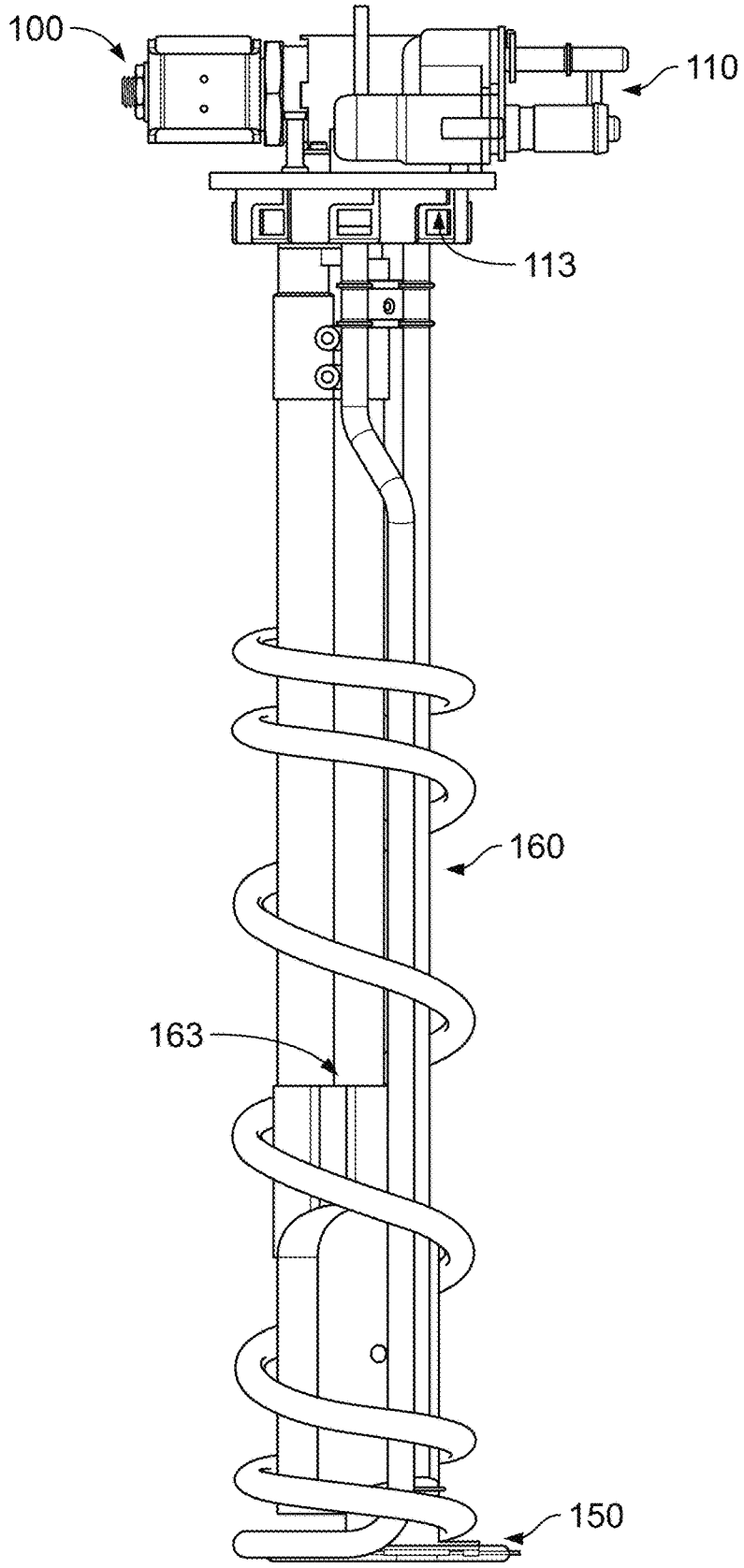
FIG. 1 shows a perspective view of an embodiment of a DEF header in accordance with various aspects disclosed herein.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DETAILED DESCRIPTION OF THE DISCLOSURE

Reference will now be made in detail to embodiments of the present teachings, examples of which are illustrated in the accompanying drawings. It is to be understood that other embodiments may be utilized and structural and functional changes may be made without departing from the scope of the present teachings. Moreover, features of the embodiments may be combined, switched, or altered without departing from the scope of the present teachings, e.g., features of each disclosed embodiment may be combined, switched, or replaced with features of the other disclosed embodiments. As such, the following description is presented by way of illustration and does not limit the various alternatives and modifications that may be made to the illustrated embodiments and still be within the spirit and scope of the present teachings.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

Turning to FIGS. 1-10, shown are embodiments of a DEF header 100 having a base configuration and multiple embodiments of header adapters 200, 300, 400 that can facilitate attachment of the header 100, e.g., a base configuration or universal header, to a DEF reservoir or tank (not shown). Generally, each individual reservoir may have different mating structures and attachment mechanisms that require different headers having different corresponding mating structures and attachment mechanisms that accommodate this specific tank structure. The header adapters 200, 300, 400 may solve the need for headers 100 having different corresponding mating structures and attachment mechanisms and facilitate attachment of header 100 having a base configuration or universal configuration to various different reservoirs and reservoir interfaces.

FIGS. 1-4 show an embodiment of header 100. Generally, the header 100 may have a base configuration or universal configuration so that is selectively attachable to any reservoirs and reservoir interfaces using a corresponding adapter (e.g., adapters 200, 300, 400). Header 100 may comprise a first end 110, a second end 150, and an elongated body 160 between the first end 110 and the second end 150. The second end 150 and elongated body 160 may be inserted into a reservoir (and remain fully within an interior of the reservoir). The first end 110 may attach to the reservoir and may extend out of the reservoir. The attachment of header 100 at its first end 110 to the reservoir (e.g., at a reservoir interface) may form a seal, such as a fluid seal. The reservoir may hold fluid, such as DEF, and header 100 may include inlets and/or outlets configured to receive, deliver, or otherwise transfer fluid, such as DEF, within a system (e.g., downstream or upstream components in a DEF system for diesel vehicles from or into the reservoir).

Figure 2:
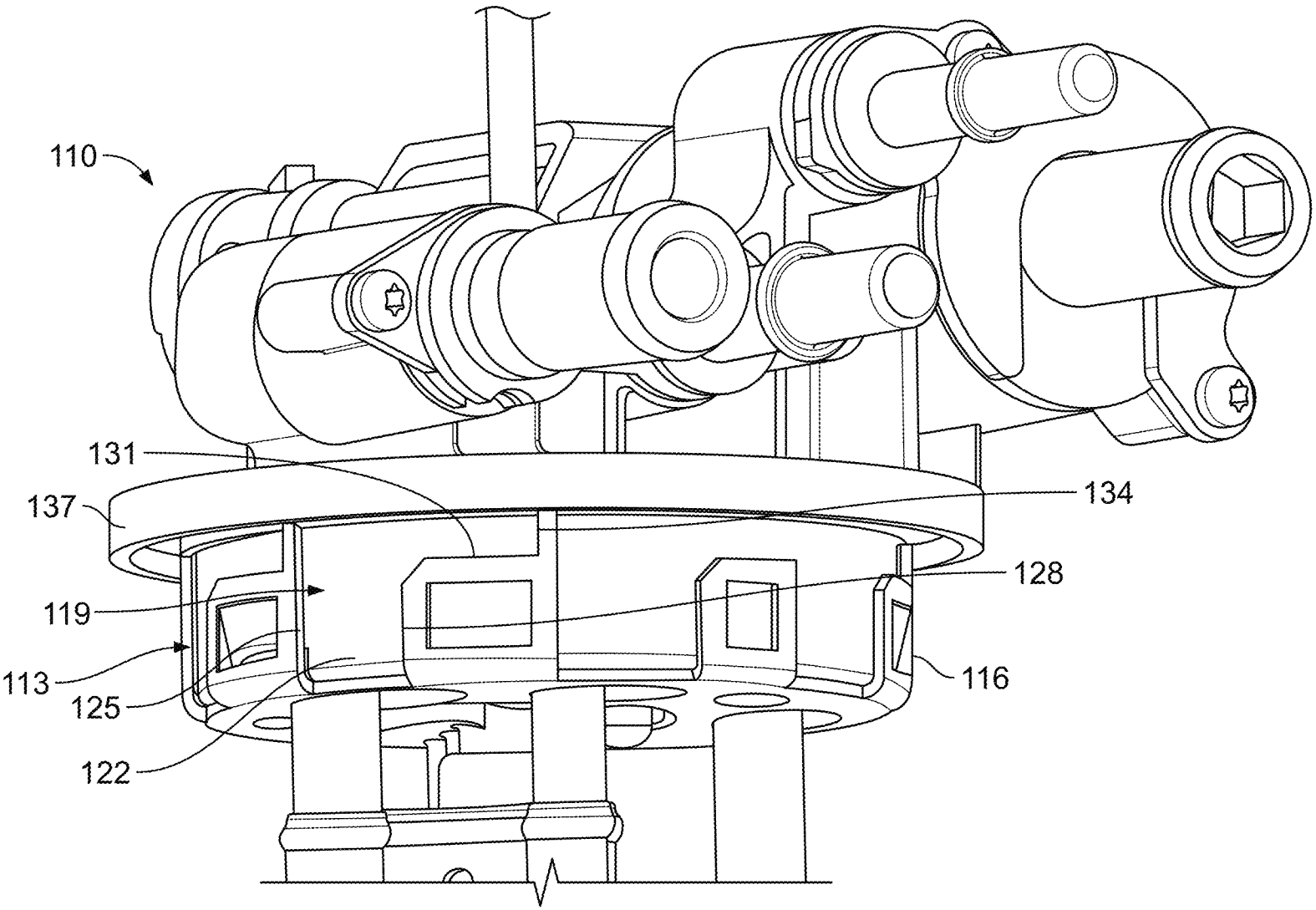
FIG. 2 shows an enlarged view of a first end of an embodiment of a DEF header in accordance with various aspects disclosed herein.
Figure 3:
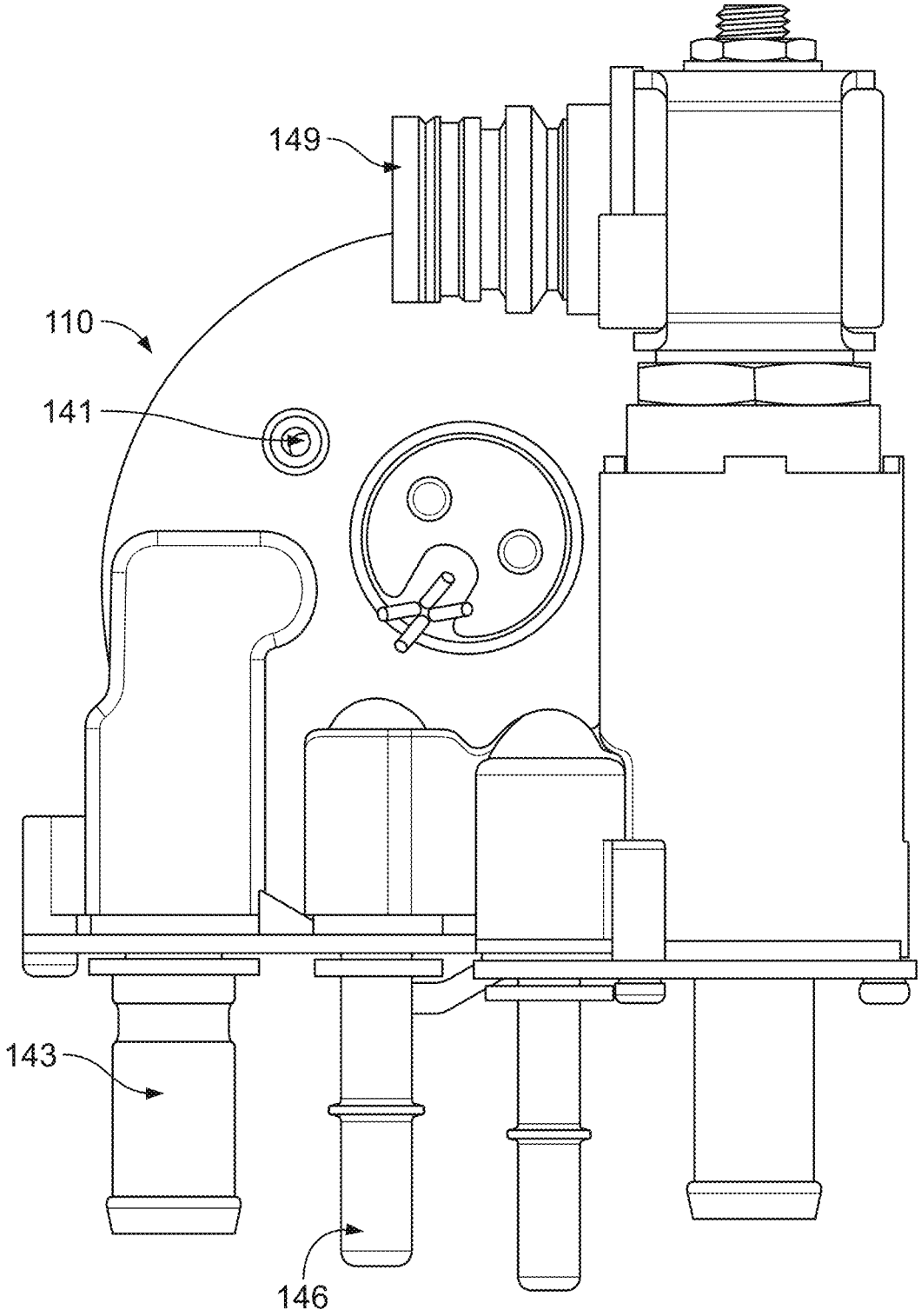
FIG. 3 shows a top view of an embodiment of a DEF header in accordance with various aspects disclosed herein.
Figure 4:
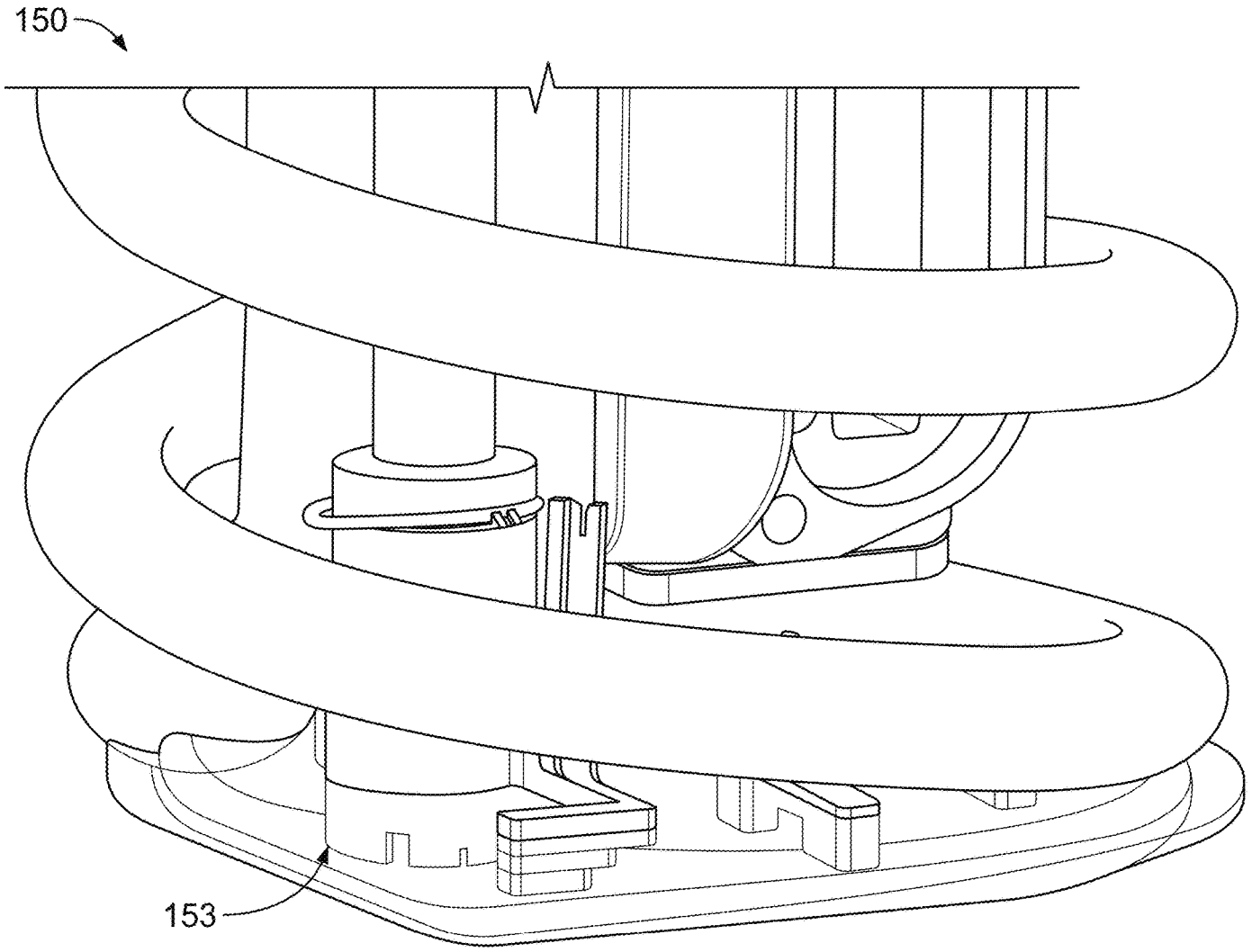
FIG. 4 shows an enlarged view of a second end of an embodiment of a DEF header in accordance with various aspects disclosed herein.

It is noted that the first end 110 may also be interchangeably referred to as a proximal end and the second end 150 may be interchangeably referred to as a distal end, or vice versa where the first end 110 is referred to as the distal and the second end 150 is referred to as the proximal end. It is noted that the first end 110 may be interchangeably referred to as a top end and the second end 150 may be interchangeably referred to as a bottom end, or vice versa. An enlarged view and a top view of the first end 110 of header 100 are shown in FIGS. 2-3, respectively. An enlarged view of the second end 150 of header 100 is shown in FIG. 4. When selectively coupled or attached to the reservoir, it is noted that the first end 110 may extend outside of or exterior to the reservoir. When selectively coupled or attached to the reservoir, it is noted that the second end 150 may insert into or may be held within an interior of the reservoir.

In an embodiment, the first end 110 may comprise an attachment portion 113. As described herein, the attachment portion 113 of the first end 110 may facilitate attachment of header 100 to the reservoir through the corresponding adapter, e.g., adapters 200, 300, 400, etc. In an embodiment, the attachment portion 113 of the first end 110 may include bayonet-style mounting features. As described herein, attachment portion 113 may be configured to attach to a corresponding attachment portion on adapters 200, 300, 400, etc. in order to facilitate attachment between the components (e.g., between the header 100 and the adapters 200, 300, 400, etc.). Although bayonet-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

In an embodiment, the first end 110 of header 100 may further comprise one or more valves, fluid lines, hose connections, and vents. The first end 110 may comprise a housing that includes or connects to these components. The first end 110 housing may have an exterior surface and interior, wherein the interior may include one or more interior cavities, conduits, chambers, pathways, or hollow portions therein. The first end 110 housing or a portion thereof may be configured to selectively restrict and permit fluid, air, and/or fluid/air flow therein or may be configured to house fluid lines, such as those for DEF and coolant. The first end 110 housing or a portion thereof may be configured to house electrical components or connections.

For example, as shown in FIG. 3, the first end 110 may include a DEF hose connection 143, a coolant hose connection 146, and a coolant control valve 149. Each of these components may positioned on an exterior surface of the first end 110 and may remain exposed from the reservoir or otherwise accessible when header 100 is inserted into and attached to the reservoir. In an example, the DEF hose connection 143 and the coolant hose connection 146 may be positioned adjacent one another on the same side of header 100 and oriented in the same direction as one another. Such configuration may lend to accessibility of the hose connections 143, 146 even when header 100 is inserted into and attached to the reservoir. In an example, the coolant control valve 149 may be positioned on a side of header 100 opposite the DEF hose connection 143 and the coolant hose connection 146. Vent 141 may comprise an aperture through the housing of the first end 110. Vent 141 may allow for accumulated air in the reservoir to be released into the ambient environment and/or may allow for air in the ambient environment to transfer into the reservoir. Vent 141 may be a one-way valve or a two-way valve allowing air to pass therethrough.

In an embodiment, as shown in FIG. 4, the second end 150 of header 100 may comprise a filter 153. Filter 153 may have a planar shape that abuts or forms a bottom surface of the second end 150. Filter 153 may generally have the same radial dimensions as the elongated body 160, second end 150, or header 100 generally. In an example, filter 153 may serve to filter particulates, air, or other components of a fluid, such as DEF, that is in the reservoir before transferring the fluid, such as DEF, to the rest of the system. In an example, filter 153 may serve to filter particulates, air, or other components of a fluid, such as DEF, that is from a fluid line before transferring the fluid, such as DEF, into the reservoir. Filter 153 may comprise any permeable membrane or porous material, including, but not limited to, wire mesh, nylon, polyester, cellulose, coalesce, resin, glass, and the like. Filter 153 may be upstream of fluid receiving or supply lines.

In an embodiment, the elongated body 160 of header 100 may have a generally cylindrical shape. The elongated body 160 may comprise one or more sensors 163 or may comprise a single multi-function sensor 163. The elongated body 160 and the sensor(s) 163 may be configured to insert into the reservoir (and into fluid within the reservoir). The sensor(s) 163 may be used to measure and determine certain reservoir and fluid conditions. For example, the sensor(s) 163 may measure and determine fluid level, temperature, concentration, and the like. The elongated body 163 may further comprise additional components, such as coolant lines, fluid lines, suction tubes, and the like. The elongated body 163 may further include a coil that wraps around and extends axially along the elongated body 163 (e.g., around the additional components of lines and/tubes). The sensor(s)

163 may interact with or relate to these additional components. The sensor(s) 163 may interact with or relate to fluid in the reservoir.

The sensor(s) 163 of the elongated body 160 may first measure a condition of the fluid and then may communicate that condition to the system, such as through a processing unit or a circuit board. The sensor(s) 163 and/or header 100 may include may include a controller housing and a controller. In an example, the controller may include a circuit board. A sensing element may be electrically coupled to the controller and may share a housing or have a separate sensing element housing. In an example, the controller, sensing element, or any other electrical component or connection as desired, may be potted in waterproof material. If the measured conditions of the fluid do not meet certain threshold required conditions, the sensor(s) 163 and/or other component in the system based on information received from the sensor(s) 163 may provide a signal or alert to the system, and can cause the system to stop the DEF flow or other processes until the problem is rectified. Such alerted conditions can include low or full DEF levels, contaminated DEF, DEF that is too hot or too cold, unmet concentration ranges, and the like.

FIGS. 5-10 show embodiments of header adapters 200, 300, 400. Header adapters 200, 300, 400 may facilitate attachment of header 100, having a base configuration or universal configuration, to various different tanks and tank interfaces that would usually otherwise require different headers and attachment mechanisms. Header adapters 200, 300, 400 can interface with both the header 100 and a reservoir in order to facilitate attachment between the components. In these embodiments, different header adapters 200, 300, 400 may be used to accommodate different tanks and tank interfaces rather than requiring entirely different headers to support the different structures. Each adapter 200, 300, 400 may include a first interface 270, 370, 470 configured to attach adapter 200, 300, 400 to header 100 and a second interface 280, 380, 480 configured to attach adapter 200, 300, 400 to a corresponding reservoir. The first interface 270, 370, 470 configured to attach adapter 200, 300, 400 to header 100 may include a bayonet-style mounting mechanism and the second interface 280, 380, 480 configured to attach adapter 200, 300, 400 to a corresponding reservoir may include a non-bayonet-style mounting mechanism (such as a 6-bolt mechanism, a bore seal mechanisms, a camlock mechanism, etc.). The first interface 270, 370, 470 configured to attach adapter 200, 300, 400 to header 100 may each have the same or generally the same mating mechanism and/or structure as one another (e.g., to attach to the same universal or has configuration headers). The second interface 280, 380, 480 configured to attach adapter 200, 300, 400 to a corresponding reservoir may each have different mating mechanisms and/or structures corresponding to the different mating mechanisms and/or structures of the reservoirs.

Figure 6A:
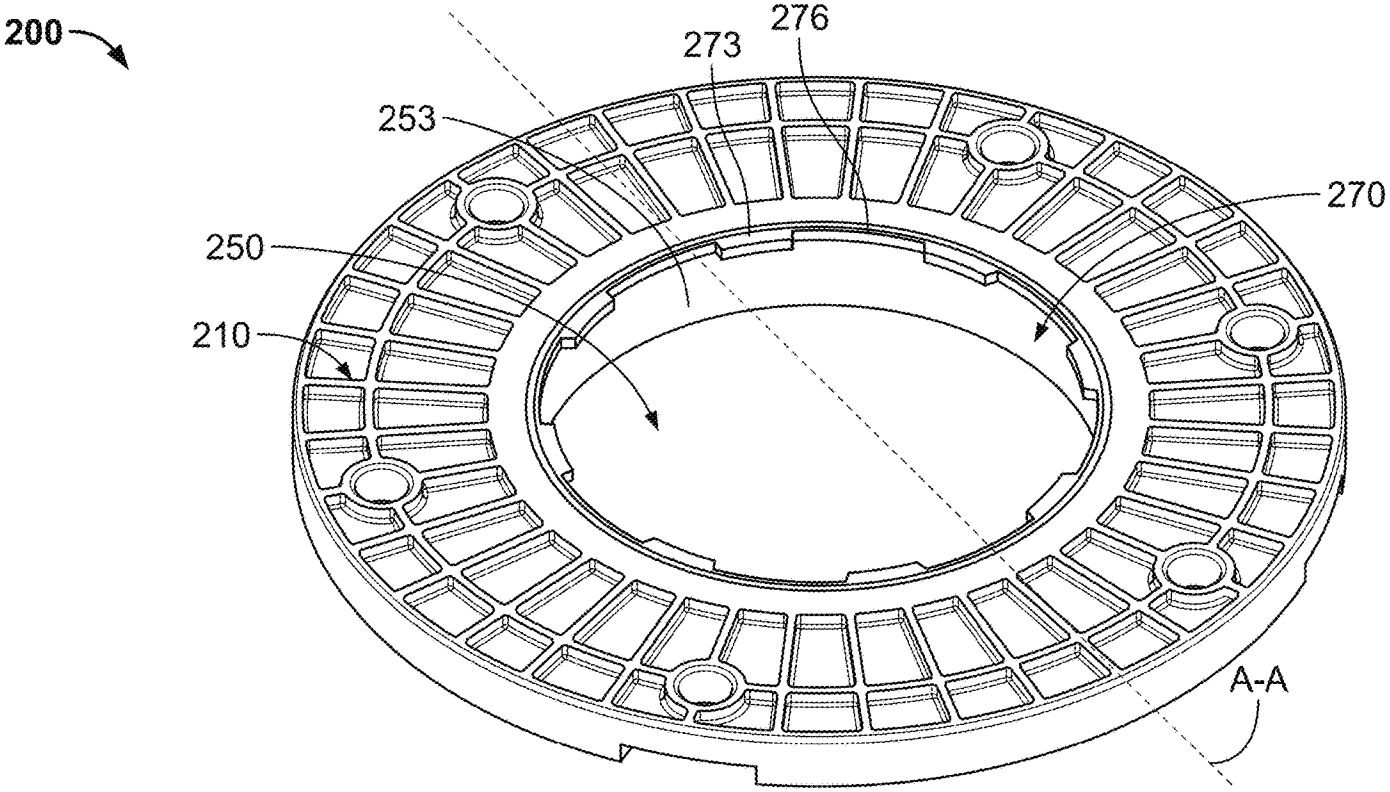
FIG. 6A shows a top of an embodiment of a first header adapter in accordance with various aspects disclosed herein.
Figure 6B:
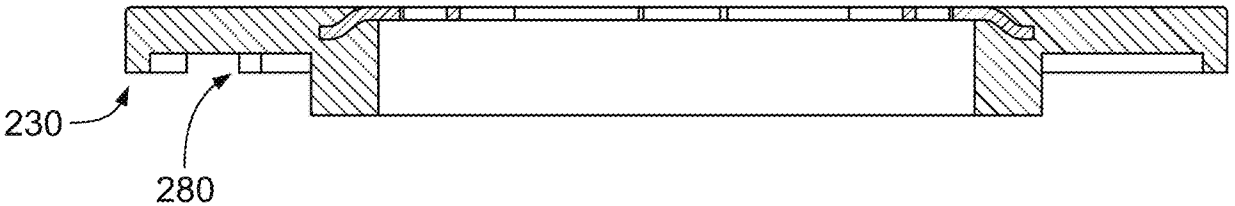
FIG. 6B shows a cross-sectional view taken along line A-A of FIG. 6A.

FIGS. 6A-B show a first embodiment of an adapter 200. Adapter 200 may comprise a first face 210 and a second face 230 opposite the first face 210. Adapter 200 may have the shape of or may also be referred to as a plate or disc. Adapter 200 may have a generally circular shape, although it is noted that any other shape may also be utilized, including ovular, square, rectangular, triangular, irregular, and the like. First face 210 may be generally planar. Adapter 200 may further comprise an opening or hole 250 that extends through the entire adapter 200 from the first face 210 through to the second face 230 of adapter 200. Opening 250 may be a central opening 250. Opening 250 may form an inner peripheral wall 253 within the body of adapter 200. Opening 250 and peripheral wall 253 may protrude from the second face 230 of adapter 200.

Adapter 200 may include a first interface 270 configured to attach adapter 200 to header 100 and a second interface 280 configured to attach adapter 200 to a corresponding reservoir. The first interface 270 may be interchangeably referred to as a header interface or header attachment mechanism. The second interface 280 may be interchangeably referred to as a tank interface or a tank attachment mechanism. It is noted that the first interface 270 for attachment to header 100 may be the same across all embodiments of adapters 200, 300, 400, etc. Header 100 may serve as a base configuration or universal header that is attachable to multiple different reservoir structures by using a corresponding adapter 200, 300, 400, etc. It is noted that the second interface 280 for attachment to the reservoir may be different across each embodiments of 200, 300, 400, etc. to provide attachment of header 100 to multiple different reservoir structures.

In an embodiment, the header interface 270 may be located on peripheral wall 253 of adapter 200. Header interface 270 may be configured to attach to or mate with attachment portion 113 on header 100. The attachment portion 113 on header 100 may also be interchangeably referred to as the adapter interface 113 of header 100. Adapter interface 113 of header 100 may selectively interlock with or otherwise attach to header interface 270 of adapter 200. Adapter selectively interface 113 and header interface 270 may interlock using may include bayonet-style mounting features. Although bayonet-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

In an example and as shown in FIGS. 2 and 6, header interface 270 of adapter 200 may include a generally cylindrical receiving/female component (e.g., opening 250 and peripheral wall 253) with one or more radial protrusions 273 located on peripheral wall 253. The radial protrusions 273 may alternate with recessed areas 276 or with areas 276 that are generally flush with the surrounding portions of peripheral wall 253. The radial protrusions 273 may located equidistant around peripheral wall 253 or the radial protrusions 273 may be located at different distances or intervals from one another. The header interface 270 may include one or more radial protrusions 273, a plurality of radial protrusions 273, or any other number of radial protrusions 273, including one, two, three, four, five, six, seven, eight, nine, ten, eleven, twelve, etc. radial protrusions 273. The radial protrusions 273 may be located on an area of peripheral wall 253 adjacent or near the first face 210. The generally cylindrical female component (e.g., opening 250 and peripheral wall 253) and one or more radial protrusions 273 may generally correspond to related (and opposite) structures on adapter interface 113 of header 100 to facilitate mating attachment between the two components.

In an example and as shown in FIGS. 2 and 6, adapter interface 113 of header 100 may include a generally cylindrical inserting/male component 116 with one or more corresponding or matching L-shaped slots 119 configured to receive and guide the radial protrusions 273 therethrough and into an attached or locked position. The L-shaped slot 119 may include opening 122 configured to receive the radial protrusions 273 therethrough. The opening 122 may include guides or walls 125, 128 on each side of the opening defining a first part of the L-shaped slot 119. Once the radial protrusions 273 enter and move into the L-shaped slot 119 through opening 122, the header 100 or adapter 200 may be turned so that the radial protrusions 273 move into a second part of the L-shaped slot 119, perpendicular to the first part of the L-shaped slot 119 and where the radial protrusions 273 are locked into place by guides or walls 131, 134. The L-shaped slots 119 may located equidistant around attachment portion 113 or the L-shaped slots 119 may be located at different distances or intervals from one another. The adapter interface 113 may include one or more L-shaped slots 119, a plurality of L-shaped slots 119, or any other number of L-shaped slots 119, including one, two, three, four, five, six, seven, eight, nine, ten, eleven, twelve, etc. L-shaped slots 119. The L-shaped slots 119 may be located on an area of attachment portion 113 adjacent or near the ridge 139. The generally cylindrical male component (e.g., attachment portion 113) and one or more L-shaped slots 119 may generally correspond to related (and opposite) structures on header interface 250 of adapter 200 to facilitate mating attachment between the two components.

In an embodiment, the second end 150 of header 100 and the elongated body 160 of header 100 may be inserted through opening 250 of adapter 200. Header 100 may include a ridge 137 near the attachment portion 113 that prevents the first end 110 header 100 from further moving through opening 250 (e.g., ridge 137 of header 100 may have a larger diameter than opening 250 of adapter 200 while second end 150 and elongated body 160 of header 100 may have a smaller diameter than opening 250 of adapter). When the attachment portion 113 of header 100 enters opening 250 of adapter 200, the radial protrusions 273 of adapter 200 may need to be aligned with opening 122 of the L-shaped slot 119 on the attachment portion 110 of header 100 in order for the attachment portion 113 of header 100 to insert into or through opening 250 of adapter 200 and into or through the first part of the L-shaped slot 119. The attachment portion 113 of header 110 may generally abut the peripheral wall 253 of adapter 200.

In an example, once the radial protrusions 237 are through the first part of the L-shaped slot 119 and the attachment portion 113 of header 100 is inserted through opening 250 of adapter 200 up to the ridge 137 of header, header 100 may be turned clockwise in order to effectuate the bayonet style lock of the adapter interface 113 and move the radial protrusions 273 into the second part of the L-shaped slot 119 (e.g., the locking portion of the L-shaped slot 119). In an example, once the radial protrusions 237 are through the first part of the L-shaped slot 119 and the attachment portion 113 of header 100 is inserted through opening 250 of adapter 200 up to the ridge 137 of header, adapter 200 may be turned counter-clockwise in order to effectuate the bayonet style lock of the adapter interface 113 and move the radial protrusions 273 into the second part of the L-shaped slot 119 (e.g., the locking portion of the L-shaped slot 119).

In an embodiment, the bayonet-style mounting features between the header interface 270 of adapter 200 and the adapter interface 113 of header 100 may include a biasing element to bias the components towards a locked position. For example, a spring may be included to bias the components in a locked or attached portion or the bayonet-style mounting features may hold in a lock position due to friction, threading, a stop point or ridge, or the like.

Although the described embodiments include radial pins on the receiving/female component of adapter 200 and L-shape slots on the inserting/male component of header 100, it is noted that opposite configurations may also be used. For example, radial pins may be provided on the inserting/male component of header 100 and L-shape slots may be provided on the receiving/female component of adapter 200.

Figure 5:
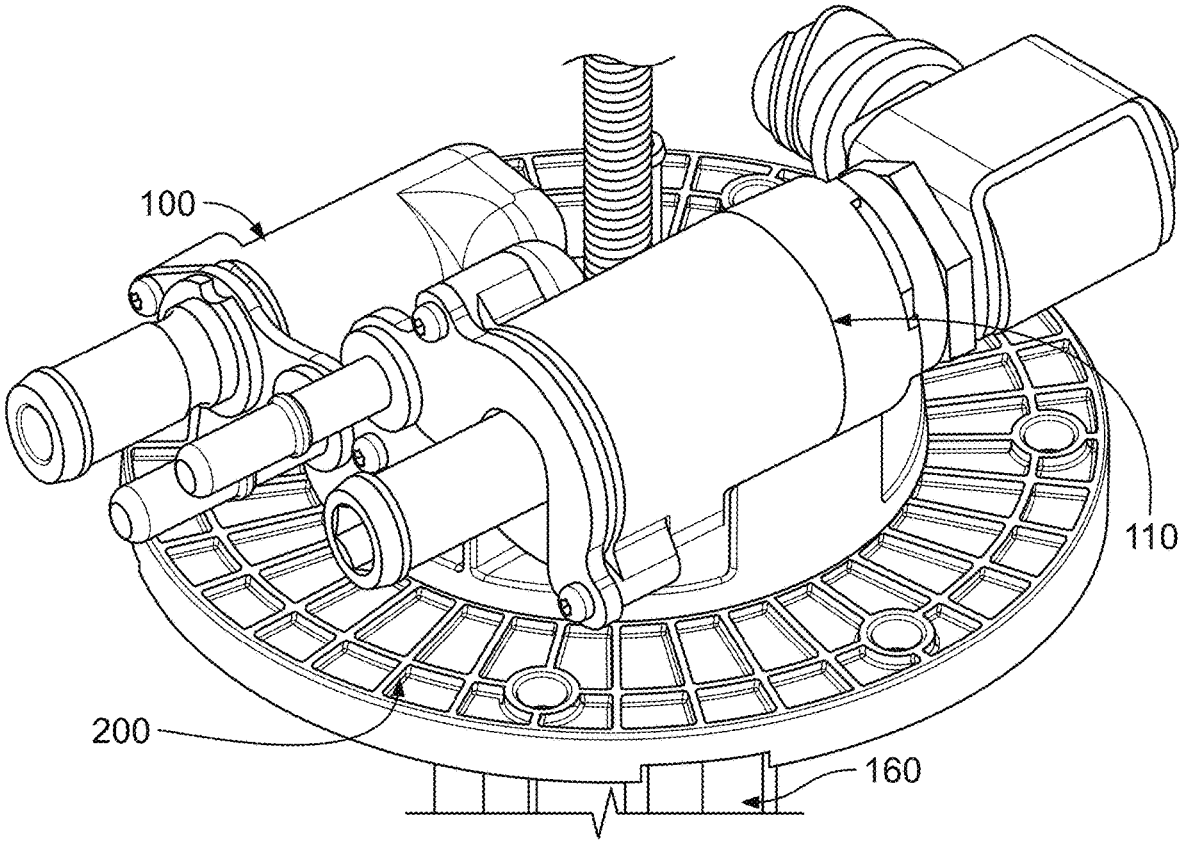
FIG. 5 shows an enlarged view of an embodiment of a DEF header assembly including a header and first header adapter in accordance with various aspects disclosed herein.

In an embodiment, the tank interface 280 may be located on second face 230 of adapter 200. Tank interface 280 may be configured to attach to or mate with a corresponding attachment portion on tank (not shown). An adapter interface on the reservoir may interlock with or otherwise attach to tank interface 280 of adapter 200. As shown in FIGS. 5-6, the adapter interface of the tank and tank interface 280 of adapter 200 may interlock using a bolt mechanism, e.g., a 6-bolt mechanism, where bolts are inserted into receiving apertures on the first face 210 of adapter 200, through the second face 230 of adapter 200, and into corresponding receiving apertures on the tank. Although bolt-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

Figure 8A:
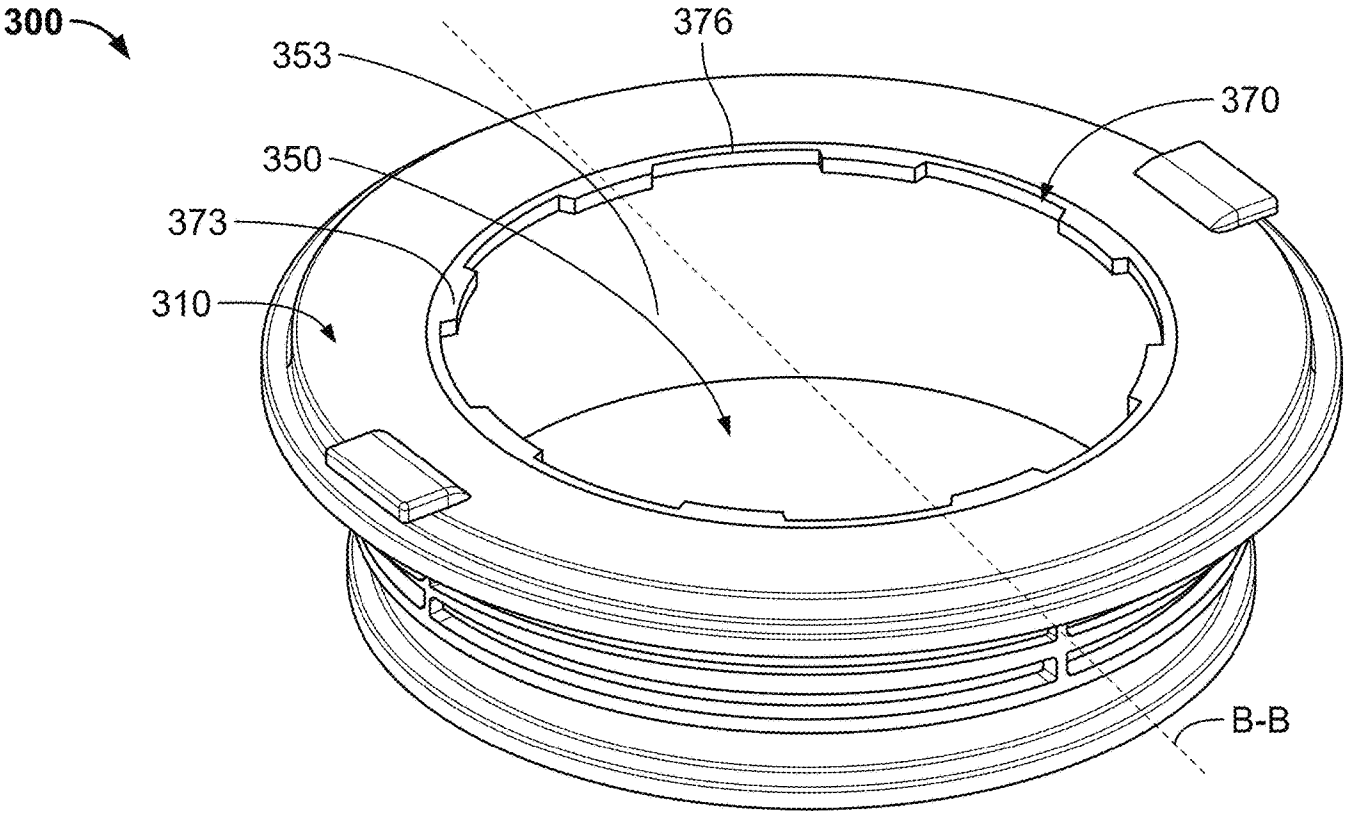
FIG. 8A shows a top view of an embodiment of a second header adapter in accordance with various aspects disclosed herein.
Figure 8B:
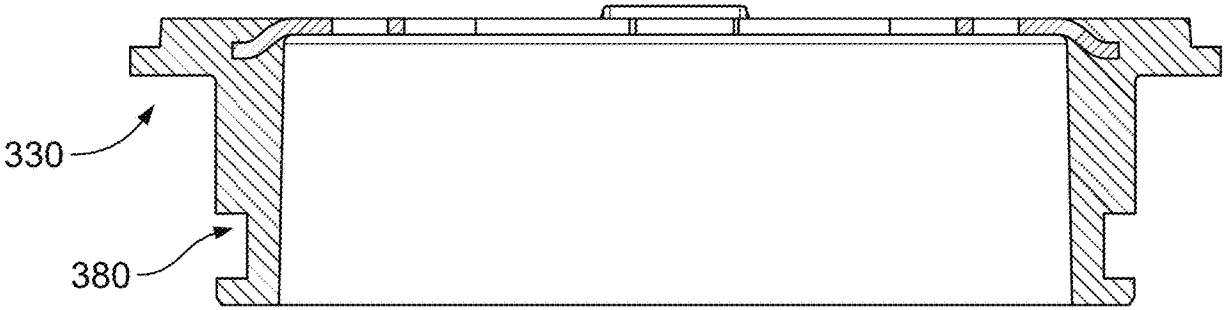
FIG. 8B shows a cross-sectional view taken along line B-B of FIG. 8A.

FIGS. 8A-B show a second embodiment of an adapter 300. Adapter 300 may comprise a first face 310 and a second face 330 opposite the first face 310. Adapter 300 may have the shape of or may also be referred to as a plate or disc. Adapter 300 may have a generally circular shape, although it is noted that any other shape may also be utilized, including ovular, square, rectangular, triangular, irregular, and the like. First face 310 may be generally planar. Adapter 300 may further comprise an opening or hole 350 that extends through the entire adapter 300 from the first face 310 through to the second face 330 of adapter 300. Opening 350 may be a central opening 350. Opening 350 may form an inner peripheral wall 353 within the body of adapter 300. Opening 350 and peripheral wall 353 may protrude from the second face 330 of adapter 300.

Adapter 300 may include a first interface 370 configured to attach adapter 300 to header 100 and a second interface 380 configured to attach adapter 300 to a corresponding reservoir. The first interface 370 may be interchangeably referred to as a header interface or header attachment mechanism. The second interface 380 may be interchangeably referred to as a tank interface or a tank attachment mechanism. It is noted that the first interface 370 for attachment to header 100 may be the same across all embodiments of adapters 200, 300, 400, etc. Header 100 may serve as a base configuration or universal header that is attachable to multiple different reservoir structures by using a corresponding adapter 200, 300, 400, etc. It is noted that the second interface 380 for attachment to the reservoir may be different across each embodiments of 200, 300, 400, etc. to provide attachment of header 100 to multiple different reservoir structures.

In an embodiment, the header interface 370 may be located on peripheral wall 353 of adapter 300. Header interface 370 may be configured to attach to or mate with attachment portion 113 on header 100. The attachment portion 113 on header 100 may also be interchangeably referred to as the adapter interface 113 of header 100.

Adapter interface 113 of header 100 may selectively interlock with or otherwise attach to header interface 370 of adapter 300. Adapter interface 113 and header interface 370 may selectively interlock using may include bayonet-style mounting features. Although bayonet-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

In an example and as shown in FIGS. 2 and 8, header interface 370 of adapter 300 may include a generally cylindrical receiving/female component (e.g., opening 350 and peripheral wall 353) with one or more radial protrusions 373 located on peripheral wall 353. The radial protrusions 373 may alternate with recessed areas 376 or with areas 376 that are generally flush with the surrounding portions of peripheral wall 353. The radial protrusions 373 may located equidistant around peripheral wall 353 or the radial protrusions 373 may be located at different distances or intervals from one another. The header interface 370 may include one or more radial protrusions 373, a plurality of radial protrusions 373, or any other number of radial protrusions 373, including one, two, three, four, five, six, seven, eight, nine, ten, eleven, twelve, etc. radial protrusions 373. The radial protrusions 373 may be located on an area of peripheral wall 353 adjacent or near the first face 310. The generally cylindrical female component (e.g., opening 350 and peripheral wall 353) and one or more radial protrusions 373 may generally correspond to related (and opposite) structures on adapter interface 113 of header 100 to facilitate mating attachment between the two components.

In an example and as shown in FIGS. 2 and 8, adapter interface 113 of header 100 may include a generally cylindrical inserting/male component 116 with one or more corresponding or matching L-shaped slots 119 configured to receive and guide the radial protrusions 373 therethrough and into an attached or locked position. The L-shaped slot 119 may include opening 122 configured to receive the radial protrusions 373 therethrough. The opening 122 may include guides or walls 125, 128 on each side of the opening defining a first part of the L-shaped slot 119. Once the radial protrusions 373 enter and move into the L-shaped slot 119 through opening 122, the header 100 or adapter 300 may be turned so that the radial protrusions 373 move into a second part of the L-shaped slot 119, perpendicular to the first part of the L-shaped slot 119 and where the radial protrusions 373 are locked into place by guides or walls 131, 134. The L-shaped slots 119 may located equidistant around attachment portion 113 or the L-shaped slots 119 may be located at different distances or intervals from one another. The adapter interface 113 may include one or more L-shaped slots 119, a plurality of L-shaped slots 119, or any other number of L-shaped slots 119, including one, two, three, four, five, six, seven, eight, nine, ten, eleven, twelve, etc. L-shaped slots 119. The L-shaped slots 119 may be located on an area of attachment portion 113 adjacent or near the ridge 139. The generally cylindrical male component (e.g., attachment portion 113) and one or more L-shaped slots 119 may generally correspond to related (and opposite) structures on header interface 350 of adapter 300 to facilitate mating attachment between the two components.

In an embodiment, the second end 150 of header 100 and the elongated body 160 of header 100 may be inserted through opening 350 of adapter 300. Header 100 may include a ridge 137 near the attachment portion 113 that prevents the first end 110 header 100 from further moving through opening 350 (e.g., ridge 137 of header 100 may have a larger diameter than opening 350 of adapter 300 while second end 150 and elongated body 160 of header 100 may have a smaller diameter than opening 350 of adapter). When the attachment portion 113 of header 100 enters opening 350 of adapter 300, the radial protrusions 373 of adapter 300 may need to be aligned with opening 122 of the L-shaped slot 119 on the attachment portion 110 of header 100 in order for the attachment portion 113 of header 100 to insert into or through opening 350 of adapter 300 and into or through the first part of the L-shaped slot 119. The attachment portion 113 of header 110 may generally abut the peripheral wall 353 of adapter 300.

In an example, once the radial protrusions 337 are through the first part of the L-shaped slot 119 and the attachment portion 113 of header 100 is inserted through opening 350 of adapter 300 up to the ridge 137 of header, header 100 may be turned clockwise in order to effectuate the bayonet style lock of the adapter interface 113 and move the radial protrusions 373 into the second part of the L-shaped slot 119 (e.g., the locking portion of the L-shaped slot 119). In an example, once the radial protrusions 337 are through the first part of the L-shaped slot 119 and the attachment portion 113 of header 100 is inserted through opening 350 of adapter 300 up to the ridge 137 of header, adapter 300 may be turned counter-clockwise in order to effectuate the bayonet style lock of the adapter interface 113 and move the radial protrusions 373 into the second part of the L-shaped slot 119 (e.g., the locking portion of the L-shaped slot 119).

In an embodiment, the bayonet-style mounting features between the header interface 370 of adapter 300 and the adapter interface 113 of header 100 may include a biasing element to bias the components towards a locked position. For example, a spring may be included to bias the components in a locked or attached portion or the bayonet-style mounting features may hold in a lock position due to friction, threading, a stop point or ridge, or the like.

Although the described embodiments include radial pins on the receiving/female component of adapter 300 and L-shape slots on the inserting/male component of header 100, it is noted that opposite configurations may also be used. For example, radial pins may be provided on the inserting/male component of header 100 and L-shape slots may be provided on the receiving/female component of adapter 300.

Figure 7:
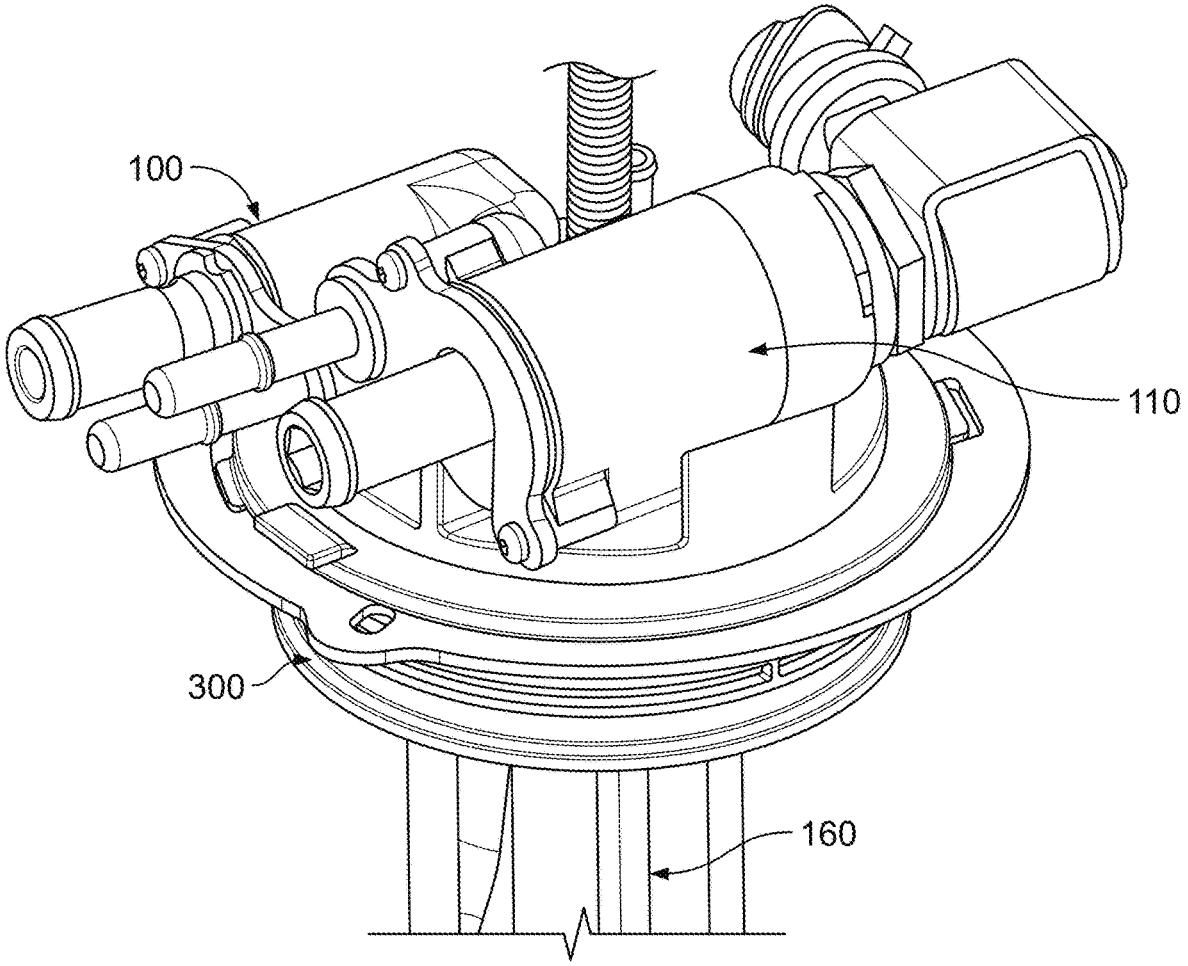
FIG. 7 shows an enlarged view of an embodiment of a DEF header assembly including a header and second header adapter in accordance with various aspects disclosed herein.

In an embodiment, the tank interface 380 may be located on second face 330 of adapter 300. Tank interface 380 may be configured to attach to or mate with a corresponding attachment portion on tank (not shown). An adapter interface on the reservoir may interlock with or otherwise attach to tank interface 380 of adapter 300. As shown in FIGS. 7-8, the adapter interface of the tank and tank interface 380 of adapter 300 may interlock using a bore seal mechanism. For example, the tank interface 380 may extend from the second face 330 of adapter 300. The tank interface 380 may be generally cylindrical or circular and may include threading or a bore seal on an exterior surface of the tank interface 380. Peripheral wall 252 may form an interior surface opposite the exterior surface of the tank interface 380. For example, the reservoir (not shown) may include a neck or an opening that includes a mating adapter interface on an interior side of the neck or the opening that is threaded or includes a bore seal and that is configured to receive and attach to the threaded or bore seal exterior surface of the tank interface 380 of adapter 300. Although threaded-style or bore-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

Figure 10A:
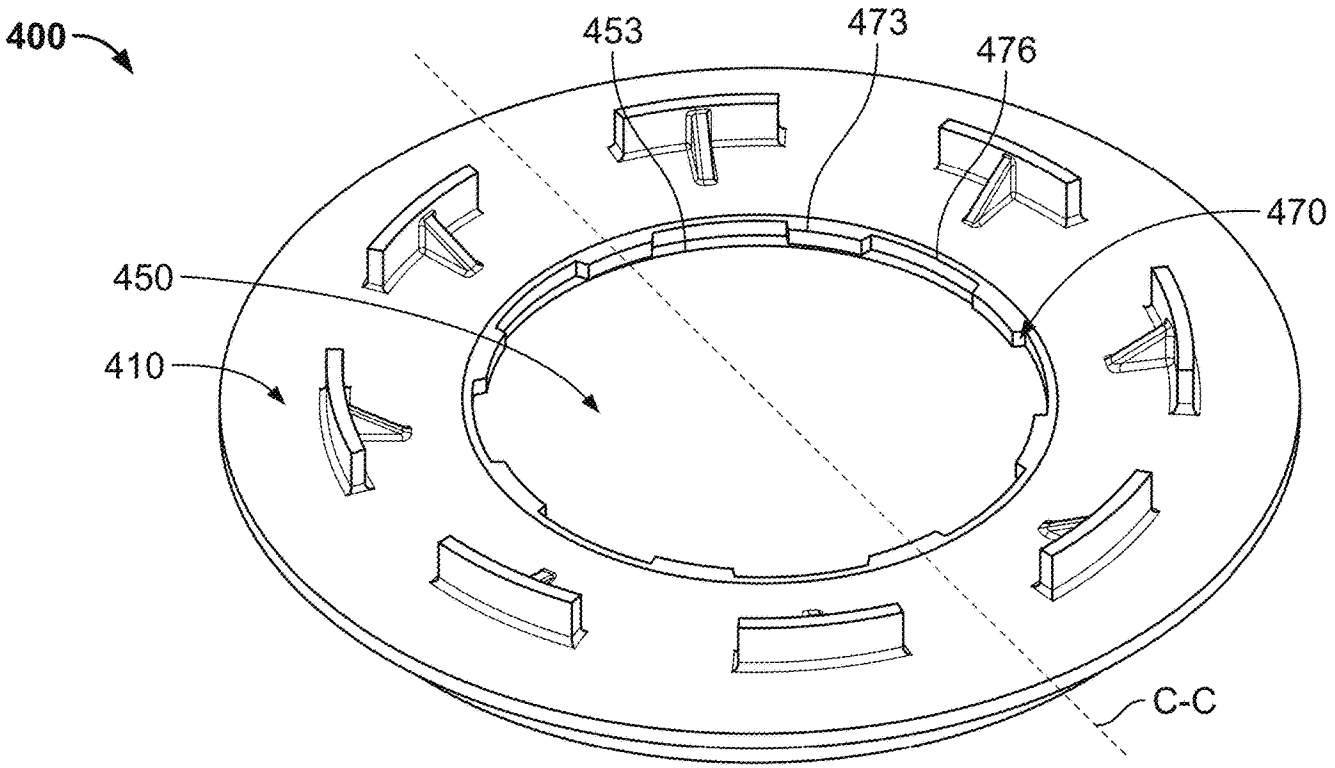
FIG. 10B shows a cross-sectional view taken along line C-C of FIG. 10A.
Figure 10B:
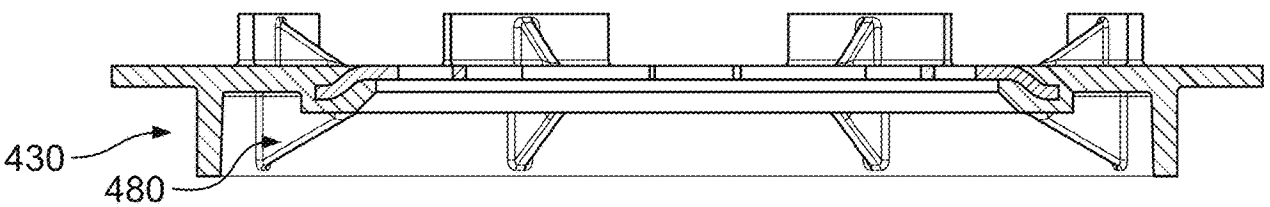

FIGS. 10A-B show a third embodiment of an adapter 400. Adapter 400 may comprise a first face 410 and a second face 430 opposite the first face 410. Adapter 400 may have the shape of or may also be referred to as a plate or disc. Adapter 400 may have a generally circular shape, although it is noted that any other shape may also be utilized, including ovular, square, rectangular, triangular, irregular, and the like. First face 410 may be generally planar. Adapter 400 may further comprise an opening or hole 450 that extends through the entire adapter 400 from the first face 410 through to the second face 430 of adapter 400. Opening 450 may be a central opening 450. Opening 450 may form an inner peripheral wall 453 within the body of adapter 400. Opening 450 and peripheral wall 453 may protrude from the second face 430 of adapter 400.

Adapter 400 may include a first interface 470 configured to attach adapter 400 to header 100 and a second interface 480 configured to attach adapter 400 to a corresponding reservoir. The first interface 470 may be interchangeably referred to as a header interface or header attachment mechanism. The second interface 480 may be interchangeably referred to as a tank interface or a tank attachment mechanism. It is noted that the first interface 470 for attachment to header 100 may be the same across all embodiments of adapters 200, 300, 400, etc. Header 100 may serve as a base configuration or universal header that is attachable to multiple different reservoir structures by using a corresponding adapter 200, 300, 400, etc. It is noted that the second interface 480 for attachment to the reservoir may be different across each embodiments of 200, 300, 400, etc. to provide attachment of header 100 to multiple different reservoir structures.

In an embodiment, the header interface 470 may be located on peripheral wall 453 of adapter 400. Header interface 470 may be configured to attach to or mate with attachment portion 113 on header 100. The attachment portion 113 on header 100 may also be interchangeably referred to as the adapter interface 113 of header 100. Adapter interface 113 of header 100 may selectively interlock with or otherwise attach to header interface 470 of adapter 400. Adapter interface 113 and header interface 470 may selectively interlock using may include bayonet-style mounting features. Although bayonet-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

In an example and as shown in FIGS. 2 and 10, header interface 470 of adapter 400 may include a generally cylindrical receiving/female component (e.g., opening 450 and peripheral wall 453) with one or more radial protrusions 473 located on peripheral wall 453. The radial protrusions 473 may alternate with recessed areas 476 or with areas 476 that are generally flush with the surrounding portions of peripheral wall 453. The radial protrusions 473 may located equidistant around peripheral wall 453 or the radial protrusions 473 may be located at different distances or intervals from one another. The header interface 470 may include one or more radial protrusions 473, a plurality of radial protrusions 473, or any other number of radial protrusions 473, including one, two, three, four, five, six, seven, eight, nine, ten, eleven, twelve, etc. radial protrusions 473. The radial protrusions 473 may be located on an area of peripheral wall 453 adjacent or near the first face 410. The generally cylindrical female component (e.g., opening 450 and peripheral wall 453) and one or more radial protrusions 473 may generally correspond to related (and opposite) structures on adapter interface 113 of header 100 to facilitate mating attachment between the two components.

In an example and as shown in FIGS. 2 and 10, adapter interface 113 of header 100 may include a generally cylindrical inserting/male component 116 with one or more corresponding or matching L-shaped slots 119 configured to receive and guide the radial protrusions 473 therethrough and into an attached or locked position. The L-shaped slot 119 may include opening 122 configured to receive the radial protrusions 473 therethrough. The opening 122 may include guides or walls 125, 128 on each side of the opening defining a first part of the L-shaped slot 119. Once the radial protrusions 473 enter and move into the L-shaped slot 119 through opening 122, the header 100 or adapter 400 may be turned so that the radial protrusions 473 move into a second part of the L-shaped slot 119, perpendicular to the first part of the L-shaped slot 119 and where the radial protrusions 473 are locked into place by guides or walls 131, 134. The L-shaped slots 119 may located equidistant around attachment portion 113 or the L-shaped slots 119 may be located at different distances or intervals from one another. The adapter interface 113 may include one or more L-shaped slots 119, a plurality of L-shaped slots 119, or any other number of L-shaped slots 119, including one, two, three, four, five, six, seven, eight, nine, ten, eleven, twelve, etc. L-shaped slots 119. The L-shaped slots 119 may be located on an area of attachment portion 113 adjacent or near the ridge 139. The generally cylindrical male component (e.g., attachment portion 113) and one or more L-shaped slots 119 may generally correspond to related (and opposite) structures on header interface 450 of adapter 400 to facilitate mating attachment between the two components.

In an embodiment, the second end 150 of header 100 and the elongated body 160 of header 100 may be inserted through opening 450 of adapter 400. Header 100 may include a ridge 137 near the attachment portion 113 that prevents the first end 110 header 100 from further moving through opening 450 (e.g., ridge 137 of header 100 may have a larger diameter than opening 450 of adapter 400 while second end 150 and elongated body 160 of header 100 may have a smaller diameter than opening 450 of adapter). When the attachment portion 113 of header 100 enters opening 450 of adapter 400, the radial protrusions 473 of adapter 400 may need to be aligned with opening 122 of the L-shaped slot 119 on the attachment portion 110 of header 100 in order for the attachment portion 113 of header 100 to insert into or through opening 450 of adapter 400 and into or through the first part of the L-shaped slot 119. The attachment portion 113 of header 110 may generally abut the peripheral wall 453 of adapter 400.

In an example, once the radial protrusions 437 are through the first part of the L-shaped slot 119 and the attachment portion 113 of header 100 is inserted through opening 450 of adapter 400 up to the ridge 137 of header, header 100 may be turned clockwise in order to effectuate the bayonet style lock of the adapter interface 113 and move the radial protrusions 473 into the second part of the L-shaped slot 119 (e.g., the locking portion of the L-shaped slot 119). In an example, once the radial protrusions 437 are through the first part of the L-shaped slot 119 and the attachment portion 113 of header 100 is inserted through opening 450 of adapter 400 up to the ridge 137 of header, adapter 400 may be turned counter-clockwise in order to effectuate the bayonet style lock of the adapter interface 113 and move the radial protrusions 473 into the second part of the L-shaped slot 119 (e.g., the locking portion of the L-shaped slot 119).

In an embodiment, the bayonet-style mounting features between the header interface 470 of adapter 400 and the adapter interface 113 of header 100 may include a biasing element to bias the components towards a locked position. For example, a spring may be included to bias the components in a locked or attached portion or the bayonet-style mounting features may hold in a lock position due to friction, threading, a stop point or ridge, or the like.

Although the described embodiments include radial pins on the receiving/female component of adapter 400 and L-shape slots on the inserting/male component of header 100, it is noted that opposite configurations may also be used. For example, radial pins may be provided on the inserting/male component of header 100 and L-shape slots may be provided on the receiving/female component of adapter 400.

Figure 9:
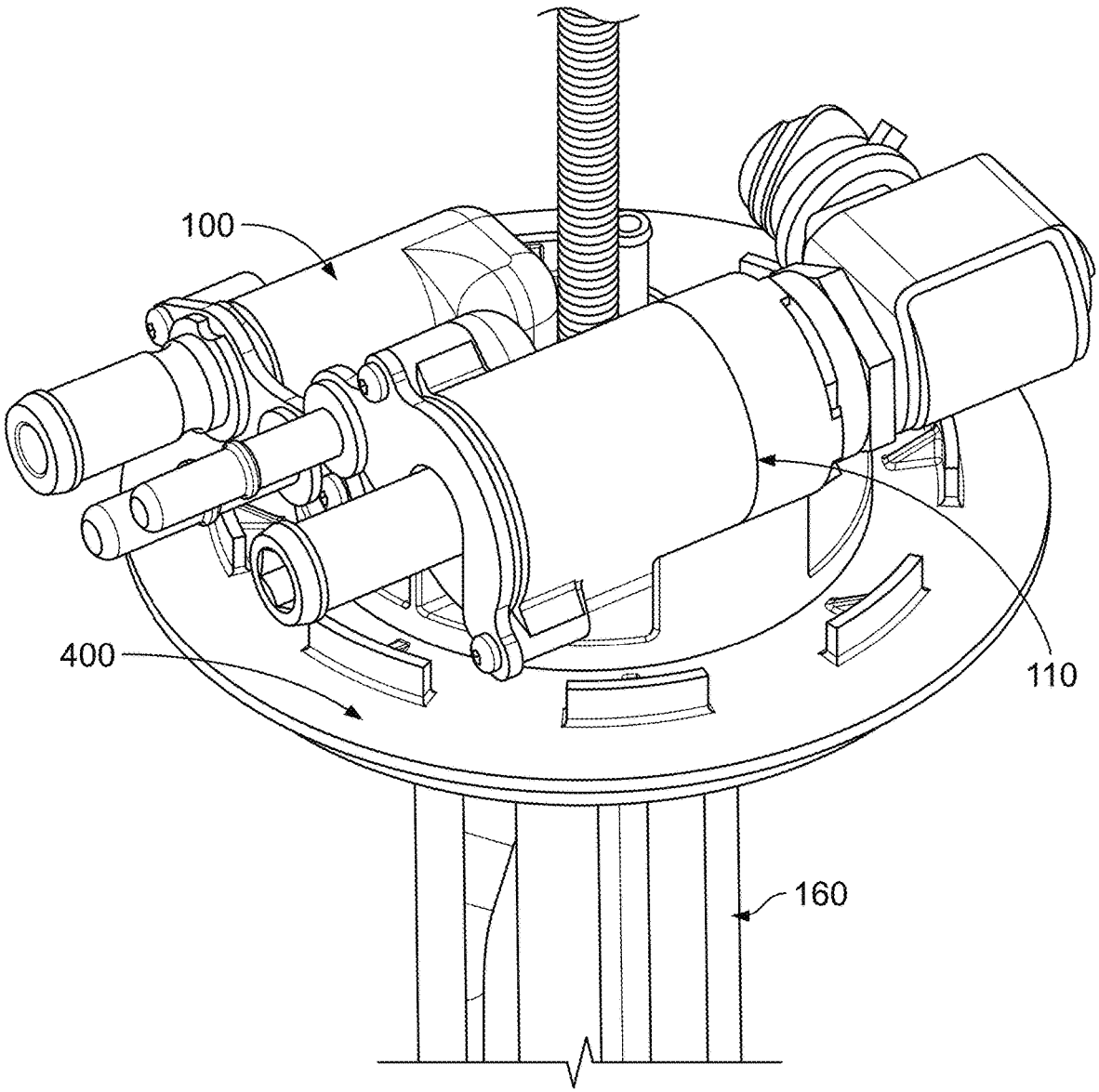
FIG. 9 shows an enlarged view of an embodiment of a DEF header assembly including a header and third header adapter in accordance with various aspects disclosed herein; and, FIG. 10A show a top view of an embodiment of a third header adapter in accordance with various aspects disclosed herein.

In an embodiment, the tank interface 480 may be located on second face 430 of adapter 400. Tank interface 480 may be configured to attach to or mate with a corresponding attachment portion on tank (not shown). An adapter interface on the reservoir may interlock with or otherwise attach to tank interface 480 of adapter 400. As shown in FIGS. 9-10, the adapter interface of the tank and tank interface 480 of adapter 400 may interlock using a SAE camlock mechanism. Although camlock-style mounting features are described, it is noted that other attachment structures, fastening mechanisms, mating attachments, and connectors may be used, including, but not limited to, threaded components, friction fit mating components, pressure fit mating components, snap-fit mating components, adhesives, O-rings, seals, fasteners (such as bolts), braces, brackets, tabs, pins, latches, snaps, bayonet mounts or interlocks, sliding interlocks, magnetic interlocks, any other female to male engagement mechanisms, and the like.

As described, adapters 200, 300, 400 may attach to header 100 having a base configuration using bayonet-style mounting. By using these adapters 200, 300, 400, header 100 is capable of assembling to multiple different tank interfaces.

As described, the header 100 and adapter 200, 300, 400 assembly includes a mounting system to mount a header to a DEF tank of a diesel exhaust system. The header implements bayonet-style mount to connect to the DEF tank. The target DEF tank includes a non-bayonet style connector, such as a six-bolt mounting connector, a bore seal connector, or an SAE camlock connector. A mounting adapter is configured to interface with the specific connector of the DEF tank. The mounting adapter defines an opening through which the header is installed. The mounting adapter includes teeth or pins on an inner circumference of the opening that receives and the header with the bayonet-style connection. When the header is installed on the DEF tank, the pins or teeth of the mounting adapter are inserted into the slots of the mounting adapter. The header is then rotated to lock the pins or teeth into the slots. The mounting adapter can include internal teeth that fit into a connector of a tank that is not a non-bayonet-style connector that facilitates a header with a bayonet-style connector connecting to the tank.

As described, header may be a single platform header or universal header with bayonet attachment to a tank interface which serves as a base configuration. Adapter plates may be used that permit the base configuration header to interface with other tank interfaces (e.g. camlock, 6-bolt, bore seal, etc.). Different adapter plates may be used for each tank interface. The disclosed embodiments using a base configuration header and different adapter plates can minimize the number stand alone configurations needed to accommodate the thousands of different tank configurations in the market.

It is noted that the term fluid as referred to herein may generally include DEF, but may further be applicable to other fluids that are not DEF. It is also noted that the term DEF as referred to herein may generally include DEF, but may further be applicable to other fluids that are not DEF. It is also noted that the terms DEF and fluid as referred to herein may generally be used interchangeably and that embodiments described herein may be used in non-diesel applications even if DEF may be described. It is noted that the terms fluidly connected and fluidly sealed as used herein may refer to both liquid and air connections and seals.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

What is claimed is:

1. A DEF universal header and adapter assembly, comprising:

a universal header comprising a first end, a second end, and an elongated body, wherein the second end and elongated body are insertable into a reservoir; and an adapter comprising a first face, a second face, and a through opening, wherein the through opening forms an inner peripheral wall comprising a header interface that is selectively attachable to a corresponding adapter interface on the universal header;

wherein the adapter further comprises a reservoir interface that is selectively attachable to the reservoir and facilitates attachment of the universal header to the reservoir, wherein the header interface of the adapter selectively interlocks with the universal header by bayonet-style mounting features.

2. The DEF universal header and adapter assembly of claim 1, wherein the universal header is selectively attachable to more than one reservoir by corresponding adapters.

3. The DEF universal header and adapter assembly of claim 2, wherein corresponding adapters comprise different reservoir interfaces configured to mate with different reservoirs.

4. The DEF universal header and adapter assembly of claim 1, wherein the header interface of the adapter comprises two or more radial protrusions and alternating two or more recessed areas.

5. The DEF universal header and adapter assembly of claim 4, wherein the header interface of the adapter comprises eight radial protrusions and alternating eight recessed areas.

6. The DEF universal header and adapter assembly of claim 5, wherein the one or more radial protrusions are spaced at even intervals about the inner peripheral wall.

7. The DEF universal header and adapter assembly of claim 4, wherein the adapter interface of the universal header comprises two or more L-shaped slots selectively configured to receive the two or more radial protrusions of the header interface of the adapter.

8. The DEF universal header and adapter assembly of claim 1, wherein the selective interlocking of the header interface of the adapter and the adapter interface of the universal header forms a liquid tight seal.

9. The DEF universal header and adapter assembly of claim 1, wherein the reservoir interface of the adapter comprises bolts to selectively attach to the reservoir.

10. The DEF universal header and adapter assembly of claim 1, wherein the reservoir interface of the adapter comprises a bore seal to selectively attach to the reservoir.

11. The DEF universal header and adapter assembly of claim 1, wherein the reservoir interface of the adapter comprises a camlock to selectively attach to the reservoir.

12. A universal DEF header, comprising:

a first end, a second end, and an elongated body, wherein the second end and elongated body are insertable into a reservoir; and an adapter interface, wherein the adapter interface selectively interlocks with an adapter and the adapter facilitates selective attachment of the universal DEF header to a reservoir, wherein the adapter interface selectively interlocks with the adapter by bayonet-style mounting features.

13. The universal DEF header of claim 12, wherein the universal DEF header is selectively attachable to more than one reservoir by one or more corresponding adapters.

14. The universal DEF header of claim 12, wherein the selective interlock between the adapter interface and the adapter and the selective attachment of the universal DEF header to the reservoir form a liquid tight seal.

15. An adapter for a universal DEF header, comprising:

a first face, a second face, and a through opening, wherein the through opening forms an inner peripheral wall including a header interface that is selectively attachable to the universal DEF header; and a reservoir interface that is selectively attachable to a reservoir, wherein the adapter facilitates attachment of the universal DEF header to the reservoir, wherein the header interface selectively interlocks with the universal DEF header by bayonet-style mounting features.

16. The adapter of claim 15, wherein the reservoir interface comprise one of: bolts, a bore seal, or a camlock to selectively attach to the reservoir.

17. A DEF universal header and adapter assembly, comprising:

a universal header comprising a first end, a second end, and an elongated body, wherein the second end and elongated body are insertable into a reservoir; and an adapter comprising a first face, a second face, and a through opening, wherein the through opening forms an inner peripheral wall comprising a header interface that is selectively attachable to a corresponding adapter interface on the universal header and wherein the header interface of the adapter comprises bayonet-style mounting features to selectively attach to the corresponding adapter interface on the universal header;

wherein the adapter further comprises a reservoir interface that is selectively attachable to the reservoir and facilitates attachment of the universal header to the reservoir, wherein the reservoir interface of the adapter comprises a camlock to selectively attach to the reservoir.

* * * * *